US005088855A

United States Patent [19]

Giliberti

[11] Patent Number: 5,088,855

[45] Date of Patent: Feb. 18, 1992

[54] VEHICLE FOR COMPACTING SURFACES

[75] Inventor: John Giliberti, West Palm Beach, Fla.

[73] Assignee: Electronic Tug Inernational, Inc., W. Palm Beach, Fla.

[21] Appl. No.: 520,264

[22] Filed: May 7, 1990

[51] Int. Cl.[5] ..... E01C 19/26

[52] U.S. Cl. ..... 404/103; 404/122; 404/128; 404/132; 180/20

[58] Field of Search ..... 404/102, 103, 75, 76, 404/122, 128, 130, 132; 180/20; 172/240, 242, 245, 246, 254

[56] References Cited

U.S. PATENT DOCUMENTS

| | | | |
|---|---|---|---|
| 1,052,643 | 2/1913 | Baechle | 404/132 |
| 1,458,751 | 6/1923 | Failor | 180/20 |
| 1,581,784 | 4/1926 | Butler | 404/103 |
| 1,935,950 | 11/1933 | Lawrence | 404/86 |
| 2,617,489 | 11/1952 | Nash | 180/20 |
| 2,778,181 | 1/1957 | Gray | 404/86 |
| 2,950,660 | 8/1960 | Standfuss | 404/103 |
| 3,326,101 | 6/1967 | Brisbin et al. | 404/102 |
| 3,625,120 | 12/1971 | Nagy | 404/122 X |
| 3,870,427 | 3/1975 | Allen | 404/103 |
| 3,905,716 | 9/1975 | Farkas | 404/122 |
| 4,040,761 | 8/1977 | Rahn | 404/122 |
| 4,555,073 | 11/1985 | Barazone | 404/103 X |
| 4,699,330 | 10/1987 | Barazone | 404/103 X |
| 4,911,248 | 3/1990 | Schrepfer | 404/122 X |
| 4,927,289 | 5/1990 | Artzberger | 404/122 |

FOREIGN PATENT DOCUMENTS

| | | |
|---|---|---|
| 2229584 | 1/1973 | Fed. Rep. of Germany . |
| 1149002 | 12/1957 | France . |
| 562316 | 6/1944 | United Kingdom . |
| 732485 | 6/1955 | United Kingdom . |

*Primary Examiner*—Bruce M. Kisliuk
*Attorney, Agent, or Firm*—Paul J. Cook

[57] ABSTRACT

A device for compacting surfaces includes a frame and wheels rotatably mounted to the frame. At least one compacting cylinder structure is rotatably mounted to the frame and has an operative position between at least two wheels and the surface to compacted. Structure for driving at least two wheels is provided. The frame is provided in the form of a vehicle whereby the weight of the vehicle and the weight of the driver contribute to compacting the surface. The compacting cylinder comprises disk structures mounted about a central shaft. The disks are secured to an inside surface of a cylindrical sleeve of the compacting cylinder which serves to reduce the inside diameter to a size compatible with a small axle diameter and to provide a cavity to support a bearing assembly. A means for engaging and disengaging the driven wheels and the compacting cylinder is provided.

6 Claims, 5 Drawing Sheets

VEHICLE FOR COMPACTING SURFACES

BACKGROUND OF THE INVENTION

This invention is related to a device for compacting surfaces, and more particularly to such devices which incorporate a rotating cylinder to compact the surface.

DESCRIPTION OF THE PRIOR ART

Rolling cylinders have been used to compact a variety of surfaces. The steam roller, for example, has long been used to compact road surfaces. Particularly with respect to tennis courts made of clay, it is necessary to periodically compact the clay surface. Rolling cylinders of metal and gas powered propulsion systems have been used in the past to compact the surfaces of clay tennis courts. These devices are loud and clamorous due to the noise from the engine, and to the vibrations induced in the solid metal compacting cylinder. These devices generally are so loud that they cannot be used when people are playing on adjacent courts. They also typically are built only for their compacting function and are not suitable to do other jobs.

It has been proposed in U.S. Pat. No. 2,778,181 to provide a roller attachment for a tractor which engages the forward surfaces of the rear wheels and, in use supports the rear wheels so that, during use, the weight of the tractor on the rear wheels is transferred to the roller. The roller is positioned under the rear wheels by means of a hand-actuated crank rod. Hydraulic means in addition to the normal power train for the tractor also can be employed. This device is undesirable since the rollers are positioned forward of the rear wheels and under the tractor and the size of the rollers is limited by the clearance of the roller between the tractor and the ground during non-use of the roller. When rolling clay surfaces, the use of a small roller is undesirable since the weight of the vehicle driving the roller will be concentrated on a small area which, in turn, will result in indentations on the surface. It is necessary to utilize a roller having a diameter of at least about twelve inches to obtain smooth rolled surfaces. In addition, the device shown in the patent requires that the roller be positioned by hand under the vehicle wheels rather than using the power of the vehicle. This is both difficult and inefficient. Alternatively, the device shown in the patent requires the use of an additional hydraulic means for positioning the roller which is expensive to install and maintain.

French Patent 1,149,002 discloses a road grading device including a scraper mounted forwardly of the rear wheels of a vehicle and compacting rollers mounted on a center support rearwardly of the rear wheels of the vehicle. The compacting rollers are undesirable because of the use of a support which requires that the compacting rollers be spaced apart from each other in noncontiguous position which, in turn, renders the treated surface nonuniform.

U.S. Pat. No. 1,935,950 and German Patent 2,229,584 utilize rollers having fluid filled tubes. These rollers are undesirable since it is difficult to control the pressure among the tubes so that the pressures are uniform. During use, gradual air losses result which eventually cause the roller to become inoperative. These non-uniform pressures result in undesirable uneven rolling.

Accordingly, it would be desirable to provide a compacting device having rollers which are not positioned below a vehicle carrying the rollers. In addition, it would be desirable to provide a roller cylinder means which is hollow so that it is sufficiently flexible to absorb vehicle vibrations during use and which eliminates the need for fluid-filled supports such as pneumatic tires which exert uneven pressures on a roller cylinder. It would also be desirable to provide a means for engaging and disengaging a compacting roller and the driving means for engaging and disengaging compacting rollers and the driving wheels of a vehicle supporting the rollers which utilizes the power of the vehicle rather than a hand operation.

SUMMARY OF THE INVENTION

The present invention provides a device for compacting surfaces which is particularly well suited for compacting clay or grass surfaces such as tennis courts.

The device comprises a powered vehicle having a frame and at least three wheels rotatably mounted to the frame. At least two compacting cylinders are rotatably mounted to the frame and have an operative position between at least two driving wheels of the vehicle and the surface to be compacted.

The compacting cylinders are pivotally mounted to the frame rearwardly of the rearward driving wheels of the vehicle. The compacting cylinders have at least one pivotal position in the operative position and at least one pivotal position in an inoperative position during which the driving wheels contact the surface to be compacted. The vehicle can be propelled on the wheels when the compacting cylinder is in the inoperative position.

Driving means for propelling at least two wheels are provided which also are used to propel the compacting cylinder in the operative position due to contact between the driven wheels and the compacting cylinder.

Means are provided for engaging the driven wheels with the compacting cylinder which utilize the driving means of the vehicle rather than hand power.

The invention comprises a vehicle to which at least three wheels are rotatably mounted, and most preferably as a vehicle having four wheels. Electric golf carts and the like are preferable because of the reduced noise levels involved in their operation. The compacting cylinder is rotatably mounted about a central support shaft that is pivotally mounted to the rear of the vehicle rearwardly of the back driving wheels of the vehicle. A block of a specific design is provided to utilize the power of the vehicle to engage and disengage the driven wheels of the vehicle and the compacting rollers. The block comprises, in cross-section, an inclined plane for each of the driven wheels and the rollers and a flat plane essentially parallel to the ground positioned between the inclined planes.

A compacting cylinder is provided according to the invention that generates reduced levels of noise during operation. Solid disk means are mounted about a central support shaft which are formed of a material sufficiently rigid to support a cylindrical sleeve and sufficiently flexible to absorb the vibrations of the vehicle and compacting cylinder. At least two cylindrical sleeves are mounted about the disks such that the inside surface of the cylindrical sleeve is secured to such as by solvent or heat bonding the circumferential periphereal surfaces of the disks. Since the disks can be machined to form a plurality of uniformly shaped disks, they can be secured to the cylindrical sleeve to provide uniform support to the sleeves over the life of the sleeve without periodic adjustment of the support disks in contrast to the requirements of inflatable tube support for the inner surfaces of the sleeve.

At least two cylindrical sleeves are mounted about the solid disks on a support shaft that is rotatably mounted to pivot a structure pivotally mounted to the frame. At least two independently rotating cylindrical sleeves provide a much smoother operation of the device when the vehicle is turned during use as compared to a single cylindrical sleeve. This can be accomplished by the provision of at least two independent axles rotatably mounted about the support shaft. At least two disks are mounted to each axle, one substantially at each end of the axle and are positioned to be on an inside surface of the sleeve opposite the outside sleeve surface which contacts a driven wheel of the vehicle. A separate cylindrical sleeve having a longitudinal axis substantially equal to about one half the length of the axle is mounted about each axle. The cylindrical sleeves can rotate independently as a function of the rotation of the driven wheel to which it contacts to allow smoother turning and rolling over uneven surfaces.

The cylindrical sleeves preferably are made from a material which produces lower noise levels than metal. Polyvinyl chloride has been found to be a preferable material although other materials more resilient than metals are also contemplated.

A vehicle produced according to the invention can be used for jobs other than compacting surfaces. The compacting cylinder will not normally interfere with the operation of the vehicle when the compacting cylinder is in the inoperative position. It is therefore within the scope of the invention to include a brush attachment for brushing a clay court surface prior to compacting. The brush is preferably pivotally mounted to the vehicle between an operative position in which the brush is in contact with the surface and an inoperative position where the brush is not in contact with the surface. The brush can be mounted to a support structure which is pivotally mounted to the vehicle. The brush preferably has a longitudingal axis substantially perpendicular to the direction of vehicle movement which is substantially parallel to the direction of the vehicle movement of substantially greater length than its lateral axis. The brush is preferably pivotally mounted to the support structure about the center of its longitudinal axis. The vehicle can also be used to perform other functions which electrical golf carts and the like are normally capable of performing.

DETAILED DESCRIPTION OF THE SPECIFIC EMBODIMENTS

Figure 4:
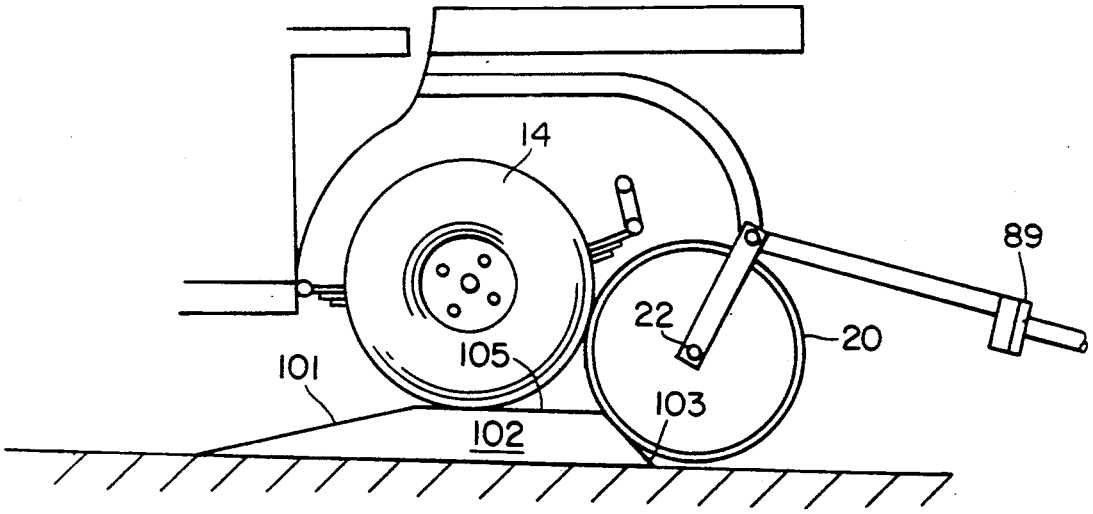
FIG. 4 is a breakaway view of the apparatus of FIG. 3 when the wheel and roller are initially engaged.

The device and method of engaging and disengaging a roller and driving wheels according to this invention will be described with reference to the drawings wherein like numbers refer to like elements. There is shown a frame 10 to which are mounted rear wheels 14 and 16. A compacting cylinder 20 is pivotally mounted to the frame 10, which in the preferred embodiment is a vehicle chassis, and has an operative position between the wheels 14 and 16 and the surface 24 to be compacted (FIGS. 2 and 4). The compacting cylinder 20 is preferably mounted about a support shaft 22. The support shaft 22 is engaged by pivot members 28 and 30. The compacting cylinder is rotatably mounted to support structure. The pivot members 28 and 30 can be pivotally mounted to extension arms 32, 34, respectively extending outwardly from the frame 10. The pivot members 28, 30 can pivot about the extension arms 32, 34 (FIG. 6) whereby the compacting cylinder 20 can be moved from an inoperative position (FIG. 1 and 7) to an operative position (FIGS. 2 and 4). A latch 38 or other similar structure can be used to detachably retain the compacting cylinder 20 in the inoperative position. The latch 38 includes a substantially U- shaped portion 40 which is adapted to engage support shaft 22.

Electric golf carts, when retrofitted to function according to the invention, should also preferably be modified if four-speed resistor type motor controllers are present. The four speed resistor type motor controller should preferably be replaced with a transistorized stepless unit that allows the vehicle to operate efficiently at any speed from zero to the maximum. A preset maximum acceleration will virtually eliminate wheel spin. Motor braking allows the operator to stop smoothly during compacting and, if desired, reverse direction without touching the brake pedal. A suitable controller is the HDI 1205 controller of the Curtis/PMC Company of Dublin, Calif.

It is preferable that the frame 10 be in the form commonly used for electric golf carts. Electric golf carts can be retrofitted to function according to the invention. This vehicle has in addition to the driven rear wheels 14 and 16, a freely rotating front wheel 44. The front wheel 44 is rotatably mounted to the front form members 46*a*, *b*, and *c*. The front form members 46 *a–c* and thus the front wheel 44 are steerable through connection to a steering column 50 having a steering wheel 54.

Figure 6:
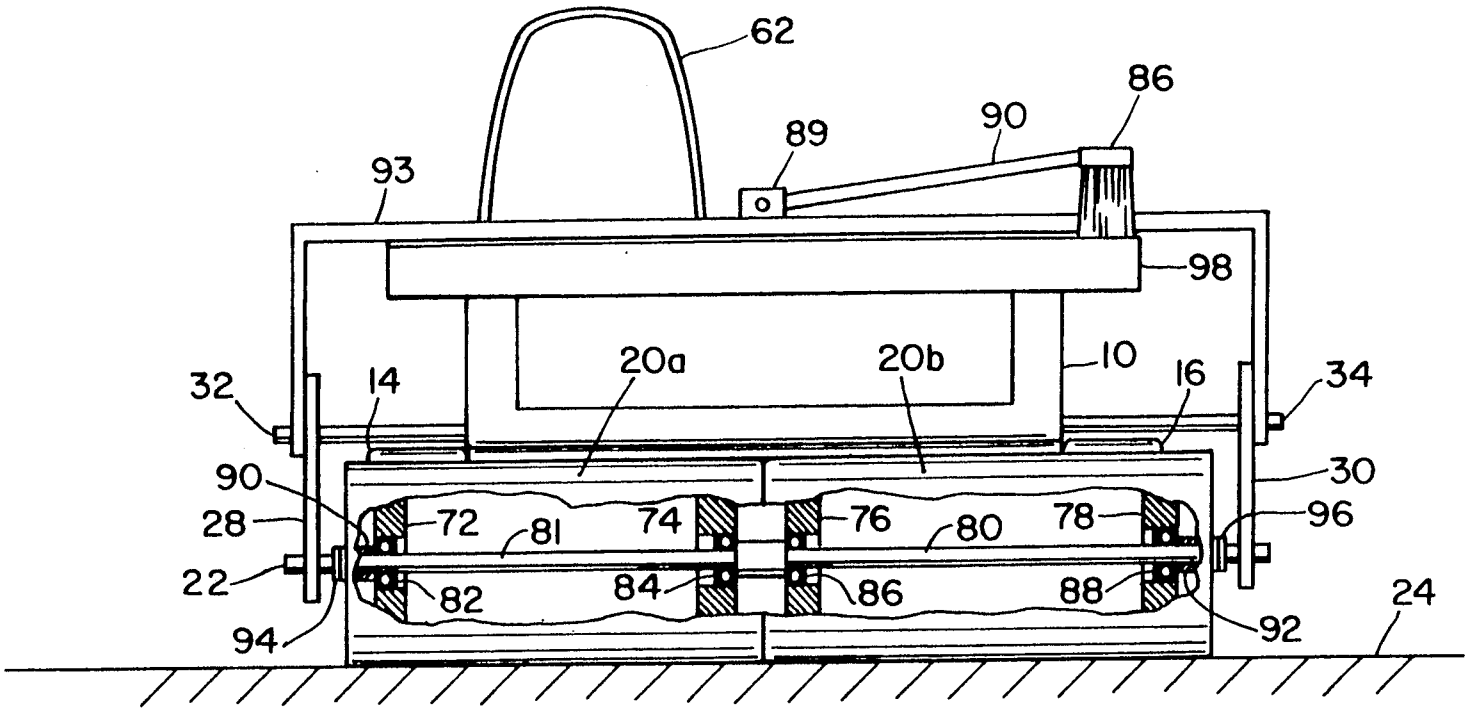
FIG. 6 is a cross-sectional view showing the structure of the compacting roller.

A driving motor 60 is located beneath the driver's seat 62 and is operatively connected to drive the rear wheels 14 and 16. Movement of the rear wheels 14 and 16 will drive the compacting cylinder 20 because it directly contacts the wheels 14 and 16 in the operative position (FIGS. 2,4 and 6). Control of the speed of the vehicle is accomplished through suitable means such as the foot pedal 66.

The construction of the frame 10 in the form of a vehicle has a number of advantages. The driving motor 60 drives the compacting cylinder 20 about the surface to be compacted when in the operative position ( FIG. 2 and 6). The weight of the motor 60 and of the driver contribute to compacting the surface by adding to the weight acting downward on the compacting cylinder 20 which comprises cylinder sleeves 20*a* and 20*b*. The invention can be substantially retrofitted to existing golf cart devices, at reduced cost to a manufacturer. The electric motor found in golf carts is also very quiet compared to the internal combustion engines commonly used to compact surfaces.

A roller, according to the invention, is provided for compacting surfaces and is shown in FIG. 6. The roller comprises solid disks 72, 74, 76 and 78 mounted to axles 80 and 81. The disks 72, 74, 76 and 78 are secured to the inner surface of sleeves 20*a* and 20*b* such as by solvent or heat bonding. The disks 72, 74, 76 and 78 are formed from a strong resilient material such as polyvinyl chloride which cushion the vibration of the compacting cylinder 20 as it is rolled over the surface to be compacted, reducing the level of noise generated during the compacting operation. The disks 72, 74, 76 and 78 are secured to rotatable ball bearing assemblies 82, 84, 86 and 88 respectively so that the disks 72, 74, 76 and 78 as well as clylinder 20*a* and 20*b* rotate relative to axle 80. Sleeves 90 and 92 as well as set collars 94 and 96 retain the bearings and contain side thrust.

Plural cylinder sleeves 20*a* and 20*b* improve the turning ability by permitting the outside cylinder(s) to turn faster than the inside cylinder(s). At least two of the disks are mounted within each cylinder 20*a* and 20*b*, one substantially near each end of the axle 80 or 81. The two cylindrical sleeves 20*b* and 20*a* are in longitudinal alignment with one another to present an even compacting cylinder surface which nonetheless can rotate at different speeds relative to the inside and outside portions of a turn.

Figure 3:
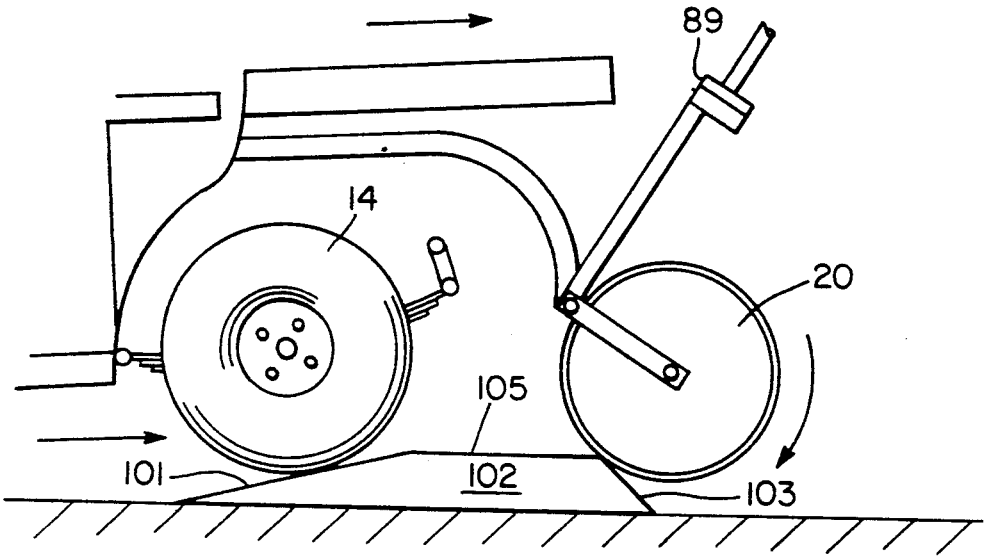
FIG. 3 is a breakaway view of the rear driven wheel-compacting roller portion of the apparatus of FIG. 1 in preparation of the wheel-roller engagement.

Engagement of the compacting cylinder 20 in the operative position with the driving wheels can be facilitated by placing block 102 on the ground between wheels 14 and 16 and compacting cylinder 20 with inclined surface 101 toward tires as pictured in FIG. 3. By utilizing motor propulsion in reverse direction in a slow and steady manner the vehicle will, in turn, be raised by inclined plane 101 to level surface 105 at which point the effects of gravity will swing pivoting compacting cylinder 20 underneath its pivotal point. The combined effects of inertia and the weight bias of scraper brush 86 causes the compacting cylinder 20 to travel past plumb and as the wheels 14 and 16 roll down inclined surface 103, roller 20 is wedged against driving wheels. Vehicle direction can now be continued in reverse to clear ramps.

Figure 1:
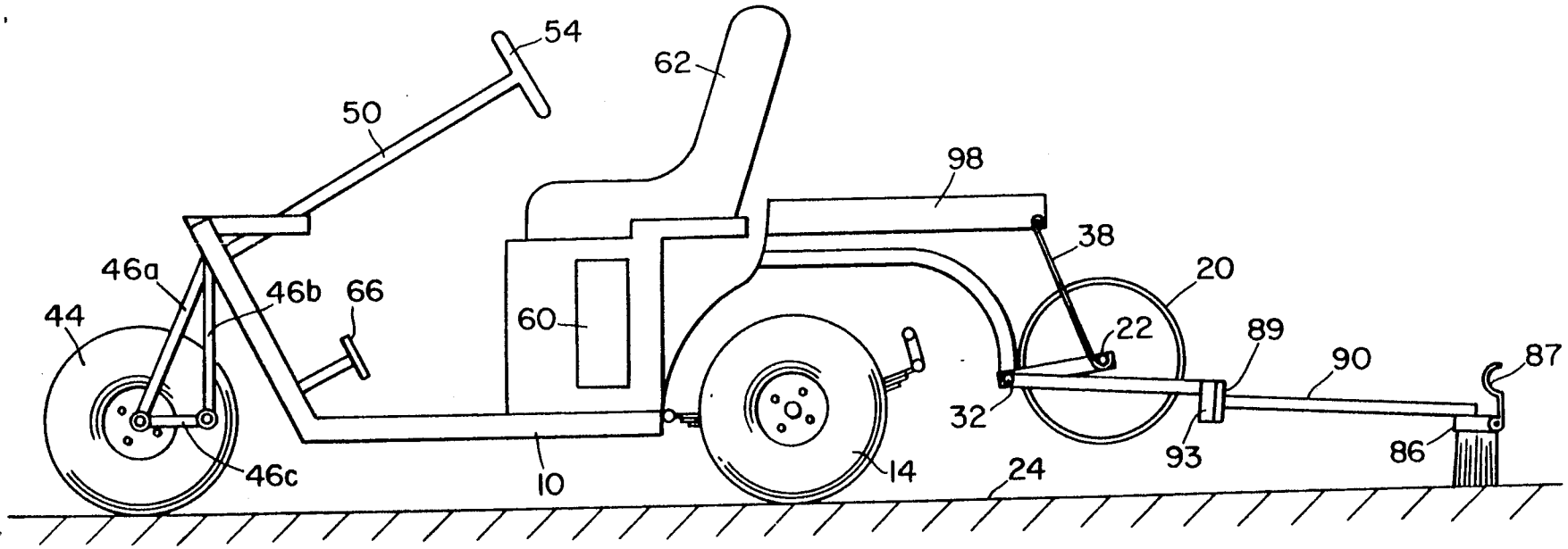
FIG. 1 is a side elevation of a device according to the invention with a compacting cylinder in the inoperative position.
Figure 2:
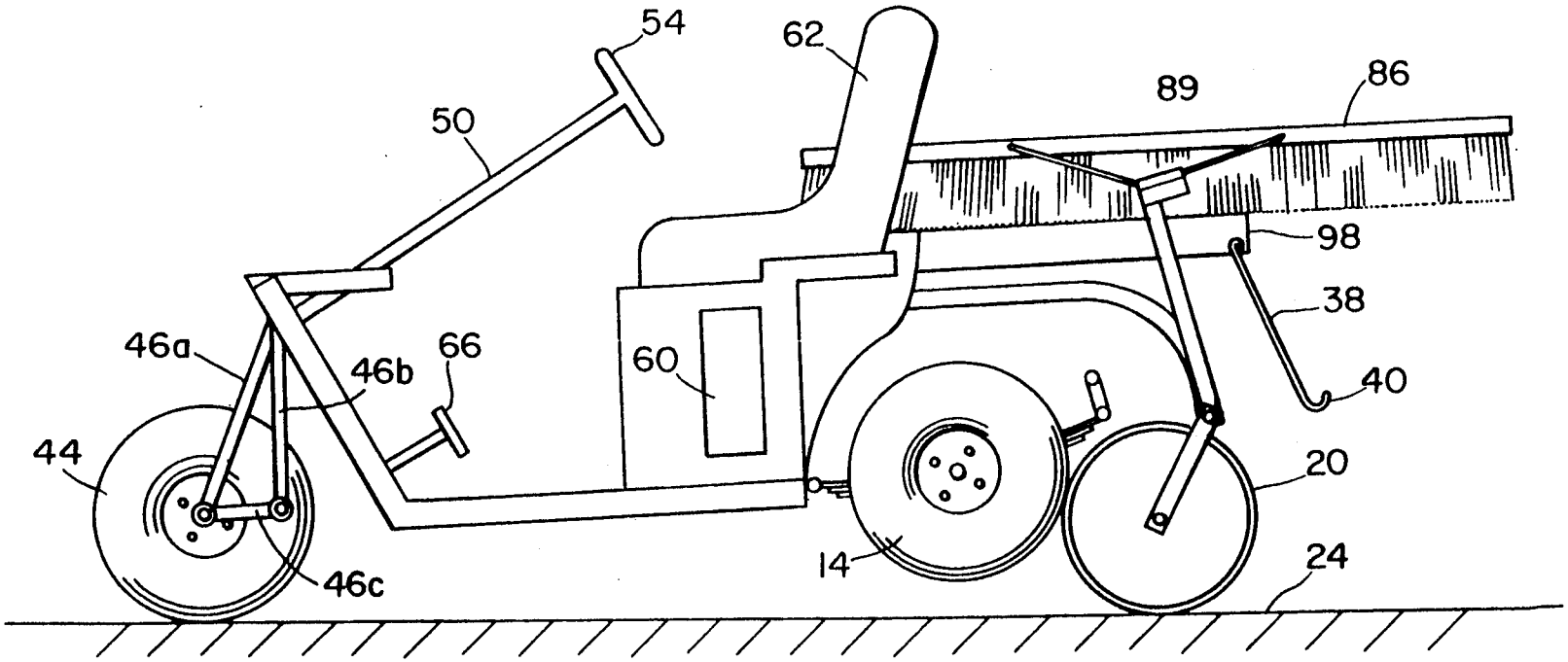
FIG. 2 is a side elevation with a compacting cylinder in an operative position.
Figure 7:
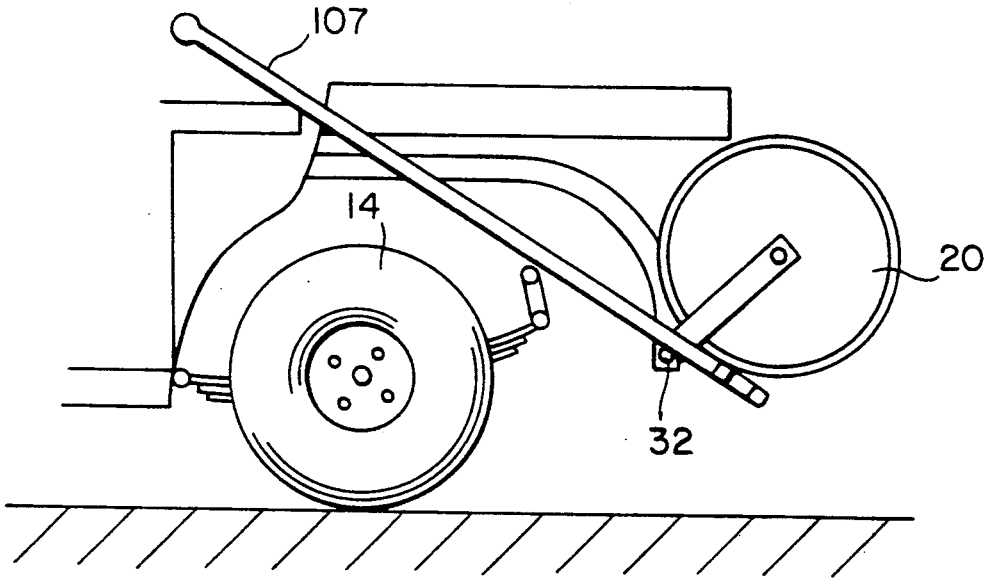
FIG. 7 is a breakaway view showing the compacting roller portion of the apparatus in a travel mode.

This invention when provided as a form of vehicle can also be used substantially according to its normal operation when the compacting cylinder 20 is latched in the inoperative position (FIG. 1 and 7). The vehicle can be used for any of the functions for which it was originally intended (if retrofitted) or for which it otherwise is suitable, as well as to perform other functions particular to the surface treatment of clay tennis courts. A brush 86 having a longitudinal dimension in excess of its lateral dimension can be mounted to a support arm 90. The brush 86 is pivotally mounted to the support arm 90 at a point central to the longitudinal axis of the brush 86. The brush will commonly be trailed behind the vehicle (FIG. 1).

A specific alternative function of the vehicle of this invention with the roller in a raised and inoperative position comprises the raking of areas such as golf course sand traps. The modified chassis is particularly suited for manuvering in, out and around golf course sand traps with preferably a change to a knobby tire pattern on its rear wheels to enhance traction. A sand trap rake 87 can be fitted to brush 86 so that a 180° repositioning on its lateral pivot by virtue of pivot connection 89 places the brush bristles up and the rake 87 down to contact the surface to be raked. The rake 87 also could be connected to longitudinal cross bar 93 as a rake support when the self-aligning feature is not desired.

The central pivotal mounting 89 of the brush 86 to the support arm 90 will cause the brush to be substantially self-aligning as it trails the vehicle. The arm 90 can be pivotally mounted to the extension arms 32 and 34 (FIG. 6) such that the brush 86 can be conveniently folded up onto a bed portion 98 of the frame 10 when the brush 86 is not in use (FIG. 6).

Figure 5:
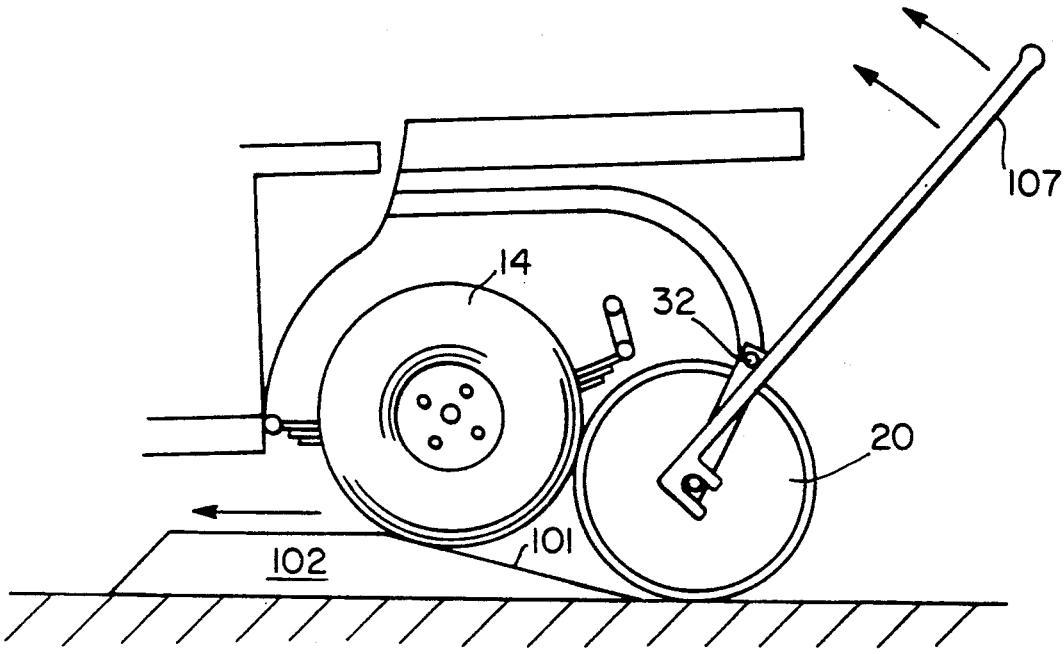
FIG. 5 is a breakaway view illustrating disengagement of the roller and wheel of the apparatus of FIG. 4.

Referring to FIG. 5, to disengage the roller 20 from the wheels 14 and 16, the block 102 is positioned so that incline 103 contacts or is in close proximity to the wheels 14 and 16. The parking brake then is set. Pivot bar 107 is engaged in groove support shaft 22. By applying forward pressure on the handle end of the lever 107 using pivot axle 32 as a fulcrum, the vehicle lifts slightly, releasing roller 20 and tires 14 and 16 on incline 101. The brake is then released allowing the wheels 14 and 16 to roll to rest on ground level. The pivot bar 107 then acts as support to roller 20 so as to travel unencumbered. However, it is to be understood that the pivot bar 107 is provided for convenience and is not necessary.

I claim:

1. Apparatus for compacting a surface which comprises a vehicle comprising a frame having at least three wheels rotatably mounted to the frame, motor means driving at least two driven wheels mounted at a rearward position on said frame, at least two compacting cylinders positioned contiguous to each other and pivotally mounted on said frame rearward of said driven wheels and adapted to rotate about an axis, said compacting cylinders having a pivotal position in an operative position rearwardly of and in contact with said driven wheels and adapted to rotate about said axis and a pivotal position in an inoperative position free of contact from said driven wheels, each of said compacting cylinders comprising a rotatable axle, at least two solid disks mounted on said rotatable axle and a cylindrical sleeve having a smooth cylindrical interior surface bonded to said solid disks and in the operative position the portion of the cylindrical sleeve opposite said interior bonded surface contacts said driven wheels.

2. The apparatus of claim 1 wherein said cylinder sleeves and said solid disks are formed of polyvinyl chloride.

3. The device for compacting surfaces of claim 1, further comprising brush means having a longitudinal length exceeding a lateral length, said brush means being pivotally mounted to support means on a vertical axis through the midpoint of said longitudinal length, said support means being mounted to said frame and having an operative position wherein said brush means contacts said surface.

4. The device for compacting surfaces of claim 3, wherein said support means is pivotally mounted to said frame.

5. The process of converting an apparatus for compacting a surface from an inoperative position to an operative position, said apparatus comprising:

a vehicle comprising a frame having at least three wheels rotatably mounted to the frame, motor means driving at least two driven wheels mounted at a rearward position on said frame, at least two compacting cylinders positioned contiguous to each other and pivotally mounted on said frame rearward of said driven wheels and adapted to rotate about an axis, said compacting cylinders having a pivotal position in an operative position rearwardly of and in contact with said driven wheels and adapted to rotate about said axis and a pivotal position in an inoperative position free of contact from said driven wheels, each of said compacting cylinders comprising a rotatable axle, at least two solid disks mounted on said rotatable axle and a cylindrical sleeve having a smooth cylindrical interior surface bonded to said solid disks.

said process comprising interposing a block having a first inclined surface and a second inclined surface separated by two relatively flat surfaces between each of said driven wheels and said compacting cylinders, moving said driven wheels by said motor means from said first inclined surface to one of said flat surfaces thereby to engage said compacting cylinders for support of said wheels free of ground support and removing said block from contact with said driven wheels and said compacting cylinders.

6. The process of claim 5 which comprises positioning a block having a first inclined surface, a second inclined surface and two relatively flat surfaces between said inclined surfaces, moving said driven wheels by said motor means to one of said flat surfaces, pivoting said compacting cylinders above said driven wheels away from the ground and moving said driven wheels by said motor means to the ground.

* * * * *